US012127607B2

(12) United States Patent
Suess et al.

(10) Patent No.: US 12,127,607 B2
(45) Date of Patent: Oct. 29, 2024

(54) BRA PAD AND METHOD FOR MANUFACTURING SAME

(71) Applicant: Chico's Brands Investments, Inc., Fort Myers, FL (US)

(72) Inventors: Emily Suess, Fort Myers, FL (US); Valerie Ann McArdle, Fort Myers, FL (US)

(73) Assignee: Chico's Brands Investments, Inc., Fort Myers, FL (US)

( * ) Notice: Subject to any disclaimer, the term of this patent is extended or adjusted under 35 U.S.C. 154(b) by 106 days.

(21) Appl. No.: 17/175,202

(22) Filed: Feb. 12, 2021

(65) Prior Publication Data

US 2022/0256943 A1 Aug. 18, 2022

(51) Int. Cl.
*A41C 3/14* (2006.01)

(52) U.S. Cl.
CPC ..... *A41C 3/144* (2013.01)

(58) Field of Classification Search
None
See application file for complete search history.

(56) References Cited

U.S. PATENT DOCUMENTS 2,041,066 A * 5/1936 Howard ..... A41C 3/144 2/237
2,834,352 A * 5/1958 Ullian ..... A41C 3/10 450/57
2,867,818 A * 1/1959 Creamer ..... A41C 3/10 623/7
3,312,224 A * 4/1967 Coates ..... A41C 3/144 264/324
3,372,698 A 3/1968 Gingras
RE26,790 E * 2/1970 Silverman ..... A41C 3/144 623/7
4,019,209 A * 4/1977 Spence ..... A61F 2/52 450/55
4,295,469 A * 10/1981 Lindgren ..... A41C 3/142 450/61
4,350,162 A * 9/1982 Kearton ..... A41C 3/10 450/86
5,215,494 A 6/1993 Flanagan
6,162,111 A 12/2000 Heroff
(Continued)

FOREIGN PATENT DOCUMENTS

CA 2750309 A1 3/2012
WO 2018022239 A1 2/2018

OTHER PUBLICATIONS

International Search Report and Written Opinion of the International Searching Authority issued on Jul. 1, 2022 for International Application No. PCT/US22/16363.

(Continued)

*Primary Examiner* — Jocelyn Bravo
(74) *Attorney, Agent, or Firm* — Kelley Drye & Warren LLP

(57) ABSTRACT

A bra pad constructed from a combination of materials and configured to have two or more zones, each zone is constructed of different material and thus provides, in combination, a different level of stretchiness and firmness to an area of the bra pad for providing optimum support, comfort, fit and coverage for use in bras, camisoles, tank tops, slips, dresses, bathing suits, or any other breast covering garment where padding and/or support is desired.

21 Claims, 3 Drawing Sheets

(56) References Cited

U.S. PATENT DOCUMENTS 6,398,620 B1 * 6/2002 Huang ..... A41C 3/144 450/57
6,425,800 B1 * 7/2002 Huang ..... A41C 3/0007 450/41
6,645,040 B2 * 11/2003 Rabinowicz ..... A41C 5/00 450/1
6,805,612 B1 * 10/2004 Luk ..... A41C 5/005 450/57
6,814,647 B1 * 11/2004 Huang ..... A41C 3/14 450/39
6,824,444 B2 * 11/2004 Huang ..... A41C 3/0007 450/39
6,997,775 B2 * 2/2006 Jagaric ..... A41C 3/10 450/39
7,309,276 B2 * 12/2007 Legaspi ..... A41C 3/10 450/41
7,556,553 B2 * 7/2009 Falla ..... A41C 5/005 450/39
7,618,304 B2 * 11/2009 Chen ..... A41C 3/146 450/38
7,722,432 B2 * 5/2010 Wood ..... A41C 5/005 450/39
RE41,654 E 9/2010 Struble et al.
7,806,748 B2 * 10/2010 Richardson ..... A41C 3/02 450/86
8,118,639 B1 * 2/2012 Boon ..... A41C 3/144 450/39
8,216,021 B1 * 7/2012 MacKinnon ..... A41C 3/144 450/57
8,388,406 B2 * 3/2013 Liu ..... A41C 3/12 450/39
9,289,017 B2 * 3/2016 Raven ..... A41C 3/144
9,596,892 B1 * 3/2017 Kornas ..... A41C 3/0092
9,737,096 B2 * 8/2017 Hirakubo ..... A41C 3/14
9,943,119 B2 4/2018 Solotoff
9,961,944 B2 5/2018 Fayad
10,660,375 B2 * 5/2020 Agee ..... A41C 5/00
11,425,941 B1 * 8/2022 Connelly ..... A41C 3/14
2002/0102913 A1 * 8/2002 Courtney ..... A41C 3/02 450/57
2003/0236053 A1 * 12/2003 Martz ..... A41C 3/144 450/39
2004/0143885 A1 * 7/2004 Rothman ..... A41C 3/04 2/104
2005/0020183 A1 * 1/2005 Falla ..... A41C 5/005 450/39
2005/0075048 A1 * 4/2005 Legaspi ..... A41C 3/10 450/41
2005/0208875 A1 * 9/2005 Jagaric ..... A41C 3/144 450/39
2006/0025041 A1 * 2/2006 Falla ..... B32B 5/26 264/161
2006/0030238 A1 * 2/2006 Jagaric ..... A41C 5/005 450/57
2006/0276105 A1 * 12/2006 Han ..... A41C 5/005 450/81
2007/0026767 A1 2/2007 Scheininger
2007/0054597 A1 * 3/2007 Mone ..... A41C 3/00 450/54
2007/0298682 A1 * 12/2007 Liu ..... A41C 3/142 450/39
2008/0139085 A1 * 6/2008 Wu ..... A41C 3/144 450/39
2009/0181599 A1 * 7/2009 Farmer ..... A41D 13/012 450/86
2009/0311943 A1 * 12/2009 Mone ..... A41C 3/10 450/38
2010/0015886 A1 * 1/2010 Waitz ..... A41C 3/10 450/86
2010/0041313 A1 * 2/2010 Castellano ..... A41C 3/144 450/86
2010/0056022 A1 * 3/2010 Liu ..... A41C 3/12 450/39
2010/0255755 A1 * 10/2010 Rose ..... A41C 3/10 450/55
2013/0183885 A1 7/2013 Yamazaki
2014/0273738 A1 * 9/2014 Raven ..... A41C 3/144 450/92
2016/0198775 A1 * 7/2016 Crompton ..... A41C 3/122 450/52
2017/0156413 A1 * 6/2017 Braverman ..... A41C 3/10
2022/0248775 A1 * 8/2022 Todaro ..... A41C 3/0021
2022/0256941 A1 * 8/2022 Suess ..... A41C 3/0021

OTHER PUBLICATIONS

International Search Report and Written Opinion of the International Searching Authority issued on Jun. 2, 2022 for International Application No. PCT/US22/16364.

* cited by examiner

BRA PAD AND METHOD FOR MANUFACTURING SAME

CROSS-REFERENCE TO RELATED APPLICATIONS

The present application is related to a co-pending application filed on the same date as the present application by inventors Emily Suess and Valerie Ann McArdle and Applicant Chico's Brands Investments, Inc., entitled "Bra with Intermediary Flexible Layer and Method for Manufacturing Same." This co-pending application is incorporated herein by reference in its entirety, including its specification, and is not admitted to be prior art with respect to the present application by its identification in this cross-reference section.

FIELD

The present disclosure relates generally to the field of bras and related garments, and more specifically, to a new and useful bra pad having two or more distinct zones to provide an optimum level of support, comfort, fit and coverage, for use in bras, camisoles, tank tops, slips, dresses, bathing suits, or any other breast covering garment where padding and/or support is desired. The bra pad of the present disclosure is used in or as a bra cup for use in any of the aforementioned garments.

BACKGROUND

As is well understood in the art, a brassiere or bra is a form-fitting undergarment designed to support, cover, restrain, reveal, modify, and/or elevate the wearer's breasts. Since their widespread use dating back nearly a century ago, bras have been improved upon to include, among other things, bra pads to further enhance the level of support and comfort provided to the wearer, as well as to improve the overall fit of the bra, visually enhance and accentuate the wearer's figure, and/or for other aesthetic or practical considerations. Other articles of clothing, such as camisoles, tank tops, slips, dresses and bathing suits have likewise been improved to include a built-in breast support component or bra with supportive bra cups and/or bra pads to achieve some or all of the same benefits of a bra.

While bras and bra pads are well known in the art, previous bras and bra pads suffer from several shortcomings. For example, due to their design, fabric and/or fabric configuration, previous bras and bra pads fail to adequately support the wearer's breasts, are uncomfortable, do not fit the wearer correctly, and/or fail to provide adequate coverage of the wearer's breasts. When a bra does not properly fit the wearer it can cause discomfort to the wearer as well as create visually unsightly results, including fit issues such as cup gaping (where the top of the bra cups fail to rest tightly against the wearer's skin and therefore creates a bulky appearance), and side and/or top overflow (where the sides and top of the bra cups are too rigid and press too tightly against the wearer's breasts causing them to bulge and/or overflow out of the top and/or sides of the bra cups).

Other issues when bra cups or bra pads fit incorrectly can include when the top or bottom of the bra cups or pads are too rigid or too tight, which can cause discomfort by cutting into the breast tissue in those areas.

Moreover, previously, bras with varying levels of support combined with minimum bulk and thickness, have been manufactured using cut panels of fabric having different support and stretch characteristics that are sewn together. In this manner, varying levels of support and stretchiness can be provided in an effort to achieve a correct and desirable fit and accommodation of the breast tissue as it is displaced by the semi-rigid areas of the cup. These "cut and sew" bras are supportive, do not add bulk to the breast and generally provide an acceptable fit and level of comfort for the wearer, but do not provide the same level of support, comfort, fit and coverage as a bra with a pad. Even traditional padded bras known in the art, which provide additional support and comfort to the wearer, fail to provide optimal support, comfort, fit and coverage. The present disclosure thus relates to a bra pad for use in bras, camisoles, tank tops, slips, dresses bathing suits, or any other breast covering garment where padding and/or support is desired that provides optimal support, comfort, fit and coverage to the wearer.

The prior art also includes certain types of bra pads. For example, U.S. Pat. App. Pub. No. 2006/0276105 teaches interleaving a reinforcing pad layer having a predetermined strength between upper and lower layers of a bra pad in order to improve support. This reference also states broadly that the reinforcing pad(s) can be of various shapes depending upon wearer taste, design and desired functions. As an example, a reinforcing pad having a higher density and hardness can be positioned toward the front of the breast tissue for increasing breast volume. In another example, a reinforcing pad is placed transversely along the upper portion of the bra cup and is smaller than a lower reinforcing pad positioned along the lower and front portion of the bra cup. These reinforcing pads have a higher density than that of the upper and lower pad cloths used for forming the molded bra cup so as to provide additional support to breast tissue.

Bra pads of graduating thickness are also known. For example, U.S. Pat. App. Pub. No. 2009/0291617 describes a bra pad comprising a generally cup-shaped body having a base perimeter, a neckline perimeter and an under arm perimeter, with the thickness of the cup-shaped body gradually tapering from the base perimeter to an apex of the cup-shaped body and then to the neckline perimeter. The bra is designed so that any metal underwire is positioned beneath the base perimeter of the bra pad for providing more comfort than that of a standard underwire bra.

The prior art also describes the use of inlays within the fabric cloths of a bra. For example, U.S. Pat. No. 8,105,130 describes an inlay formed of a resilient shape-maintaining plastics material, generally crescent shaped. The inlay is said to increase the comfort of the bra wearer due to a predetermined thickness providing resilient bending about various axes.

Further, U.S. Pat. No. 6,997,775 describes a bra in which a layer of foam forming the bra pad is manufactured of shaved polyurethane foam. For example, FIGS. 1-4 illustrate a foam shaving process and apparatus for forming a bra pad having a foam layer with a defined shape and thicker material areas for extending over the summits of the breasts.

SUMMARY

The present disclosure describes bra pads to be used in or as bra cups for use in bras, camisoles, tank tops, slips, dresses, bathing suits, or any other breast covering garment where padding and/or support is desired that improve the level of support, comfort, fit and coverage provided to a wearer of the bra or garment containing the bra pad disclosed herein, and that visually enhance the wearer's figure by, among other things, preventing cup gaping and side and/or top overflow or bulging. It should be understood that the use of the term "bra" herein refers to articles of clothing, such as standalone bras and bras built into any of camisoles, tank tops, slips, dresses, bathing suits, or any other breast covering garment where support, comfort and/or coverage of the wearer's breasts is desired.

In one aspect of the present disclosure, a bra pad is provided that comprises a specific configuration and specific materials containing different degrees of stretchiness and/or firmness that provides the optimum level of support, comfort, fit and coverage to the wearer, and visually enhances the wearer's figure by, among other things, preventing cup gaping and side and/or top overflow or bulging.

In another aspect of the present disclosure, the bra pad described herein may be constructed from two or more different materials, each material possessing and providing different degrees of stretchiness and/or firmness to different areas of the wearer's breasts.

In another aspect of the present disclosure, the bra pad described herein may comprise two or more zones. Each zone may be provided in a particular location of the bra pad and may be constructed from a specific material consisting of different degrees of stretchiness and/or firmness and thus provides different levels of support, comfort and fit to different regions of the wearer's breast. Specifically, the bra pad configuration described herein may comprise two zones when viewed in the orientation of when the bra pad is placed on the body of a wearer: (1) a first or top zone closest to the wearer's neckline when on the body having a top and bottom portion and comprising a stretchable material, and (2) a second or bottom zone near the bottom of the wearer's breast when on the body having a top and bottom portion and comprising a stabilizing and firm yet stretchable material, whereby the top portion of the bottom zone is coupled to the bottom portion of the top zone. The two zones in the aggregate may be coextensive with the entire surface area of the bra pad, with each of the zones of the bra pad being characterized by a different stretchiness and/or firmness property for providing optimum support, comfort, fit and coverage for the corresponding area of the wearer's breasts.

In yet another aspect of the present disclosure, the bra pad described herein may be constructed from a combination of materials and may be configured to have three zones. Each zone may be constructed of different material and thus may provide a different level of stretchiness and/or firmness to an area of the bra pad. The zones, in combination, may therefore furnish optimum support, comfort, fit, coverage and appearance to different areas of the wearer's breasts. Specifically, the bra pad configuration described herein may comprise three zones when viewed in the orientation of when the bra pad is placed on the body of a wearer: (1) a first or top zone closest to the wearer's neckline when on the body having a top and bottom portion and comprising a stretchable material, (2) a second or bottom zone near the bottom of the wearer's breast when on the body having a top and bottom portion and comprising a stabilizing and firm yet stretchable material, and (3) a third or middle zone having a top and bottom portion and comprising a generally lightweight stretchable foam material, whereby the middle zone is provided between the top and bottom zones such that the top portion of the middle zone is coupled to the bottom portion of the top zone and the bottom portion of the middle zone is coupled to the top portion of the bottom zone. The three zones in the aggregate may be coextensive with the entire surface area of the bra pad, with each of the zones of the bra pad being characterized by a different stretchiness and firmness property for providing optimum support, comfort, fit and coverage for the corresponding area of the wearer's breasts.

In another aspect of the present disclosure, the top zone of the bra pad may comprise a stretchable material, which may be designed to fit snugly against and along the wearer's neckline or near the top of the wearer's breasts and may be further designed to stretch and recover specific to the wearer's body to accommodate the wearer's body throughout the day and for extended periods of time. Specifically, the top zone of the bra pad, comprising stretchable material, may contain stretching properties and may be designed to stretch and accommodate the wearer's body at the neckline or near the top of the wearer's breasts for extended periods of time to maintain comfort, support, fit, coverage and appearance. The top zone of the bra pad, comprising stretchable material, may also contain properties that allow it to contract or fully recover from a stretched position back to its original position and, therefore, may be designed to adapt to the wearer's body and accommodate the wearer's body as it fluctuates in size and shape. In other words, the top zone may be constructed such that its stretching properties do not get exhausted or used up, and can snap back or recover to its original position so as to maintain a snug fit to the wearer's body. The stretching and recovery properties of the top zone of the bra pad may also provide improved support, comfort, fit and coverage, while preventing top and/or side cup overflow and cup gaping. For example, by stretching to sufficiently accommodate the wearer's breasts, the top zone of the bra pad fully and comfortably covers the top and sides of the wearer's breasts and does not pinch or cut into the wearer's breasts, thus creating a comfortable, supportive fit that prevents the top and side portions of the wearer's breasts from overflowing or bulging out of the bra pad. Moreover, by fully recovering and maintaining a snug fit along the top of the wearer's breasts as the wearer's breasts fluctuate in size and shape, the top zone of the bra pad prevents cup gaping.

In another aspect of the present disclosure, the bottom zone of the bra pad may comprise a firm, stabilizing material with minimal or restrictive stretching properties, which is designed to fit snugly along the bottom of the wearer's breasts to provide improved support, comfort, fit and appearance to the wearer. Specifically, the bottom zone of the bra pad, comprising a firm, stabilizing material, may be designed to flex along the bottom of the wearer's breasts to provide additional support and to provide "lift" to the breasts. The bottom zone, while it may be flexible enough to accommodate the varying sizes of the wearer's breasts as they grow and/or shrink, is rigid enough to provide additional support to the wearer's breasts. Moreover, the material(s) used to create the bottom zone may comprise certain properties that allow it to be flexible enough to not dig into the wearer's breast tissue but firm enough to provide adequate support to the wearer's breasts. The bottom zone may further comprise an additional component that extends substantially vertically up the side of the bra pad near the wearer's armpit when worn, which may be referred to as a sling, that may be constructed of similar or the same firm, stabilizing material as the bottom zone. The sling may overlap the top zone, or vice versa, at or near the strap point—where the bra strap connects to the bra pad—to provide more rigidity or a firmer stretch and, thus additional support, at the strap point. The sling may provide further support to the side and bottom of the wearer's breasts and may push the wearer's breasts forward providing "lift" to the breasts while preventing side bulge or cup overflow.

In yet another aspect of the present disclosure, the middle zone of the bra pad may be provided between the top and bottom zones and may comprise a lightweight, stretchable foam material, which may be designed to fit snugly and comfortably against the middle portion of the wearer's breasts to provide added support and comfort to those areas when the bra pad is worn.

In one aspect, a bra pad is described that when placed on the body of a wearer comprises: a first zone comprising a stretchable material; and a second zone coupled to the first zone and comprising a rigid material. Moreover, the bra pad may further comprise a third zone arranged between the first zone and the second zone, the third zone comprises a lightweight, stretchable material.

Furthermore, in accordance with the present disclosure, a method for manufacturing a bra pad is provided comprising the steps of: providing a first zone comprising a stretchable material; and coupling a second zone comprising a rigid material to the first zone. The method of manufacturing the bra pad may further comprise arranging a third zone between the first zone and the second zone, wherein the third zone comprises a lightweight, stretchable material.

In another aspect of the present disclosure, a method for manufacturing a bra pad is provided comprising the steps of: providing a first zone comprising a stretchable material to be used as a top zone of the bra pad, providing a second zone comprising a lightweight, stretchable foam material to be used as a middle zone of the bra pad, providing a third zone comprising a rigid material to be used as a bottom zone of the bra pad; coupling the bottom portion of the first zone to the top portion of the second zone; coupling the bottom portion of the second zone to the top portion of the third zone; and coupling one or more portions of the third zone to the first zone.

Numerous variations of the bra pads described herein may be practiced in the preferred embodiment. Other features and advantages of the subject matter described herein will be apparent from the description and drawings, and from the claims.

BRIEF DESCRIPTION OF THE DRAWINGS

A further understanding of the subject matter described herein can be obtained by reference to exemplary embodiments set forth in the illustrations of the accompanying drawings. Although the illustrated embodiments are merely exemplary of apparatuses described herein, both the organization and method of operation and manufacture thereof, in general, together with further objectives and advantages thereof, may be more easily understood by reference to the drawings and the following description. Like reference numbers generally refer to like features (e.g., functionally similar and/or structurally similar elements).

The drawings are not necessarily depicted to scale; in some instances, various aspects of the subject matter disclosed herein may be shown exaggerated or enlarged in the drawings to facilitate an understanding of different features. Also, the drawings are not intended to limit the scope of this invention, which is set forth with particularity in the claims as appended hereto or as subsequently amended, but merely to clarify and exemplify the present disclosure.

DETAILED DESCRIPTION

The present disclosure may be understood more readily by reference to the following detailed descriptions of exemplary embodiments of the subject matter disclosed herein. However, devices, apparatuses, systems, structures and methods of manufacturing the same in accordance with the present disclosure may be embodied in a wide variety of forms and modes, some of which may be quite different from those in the disclosed embodiments. Also, the features and elements disclosed herein may be combined to form various combinations without exclusivity, unless expressly stated otherwise. Consequently, the specific structural and functional details disclosed herein are merely representative. Yet, in that regard, they are deemed to afford the best embodiments for purposes of disclosure and to provide a basis for the claims herein, which define the scope of the invention. It should also be noted that, as used in the specification and the appended claims, the singular forms "a", "an", and "the" include plural referents unless the context clearly indicates otherwise.

Use of the term "exemplary" means illustrative or by way of example, and any reference herein to "the invention" is not intended to restrict or limit the present disclosure to the exact features of any one or more of the exemplary embodiments disclosed herein. Also, repeated use of the phrase "in one embodiment," "in an exemplary embodiment," or similar phrases do not necessarily refer to the same embodiment, although they may. It is also noted that terms such as "preferably," "commonly," and "typically," are not used herein to limit the scope of the claimed invention or to imply that certain features are critical, essential, or even important to the structure or function of the claimed invention. Rather, those terms are merely intended to highlight alternative or additional features that may or may not be used in a particular embodiment of the present disclosure.

Figure 1:
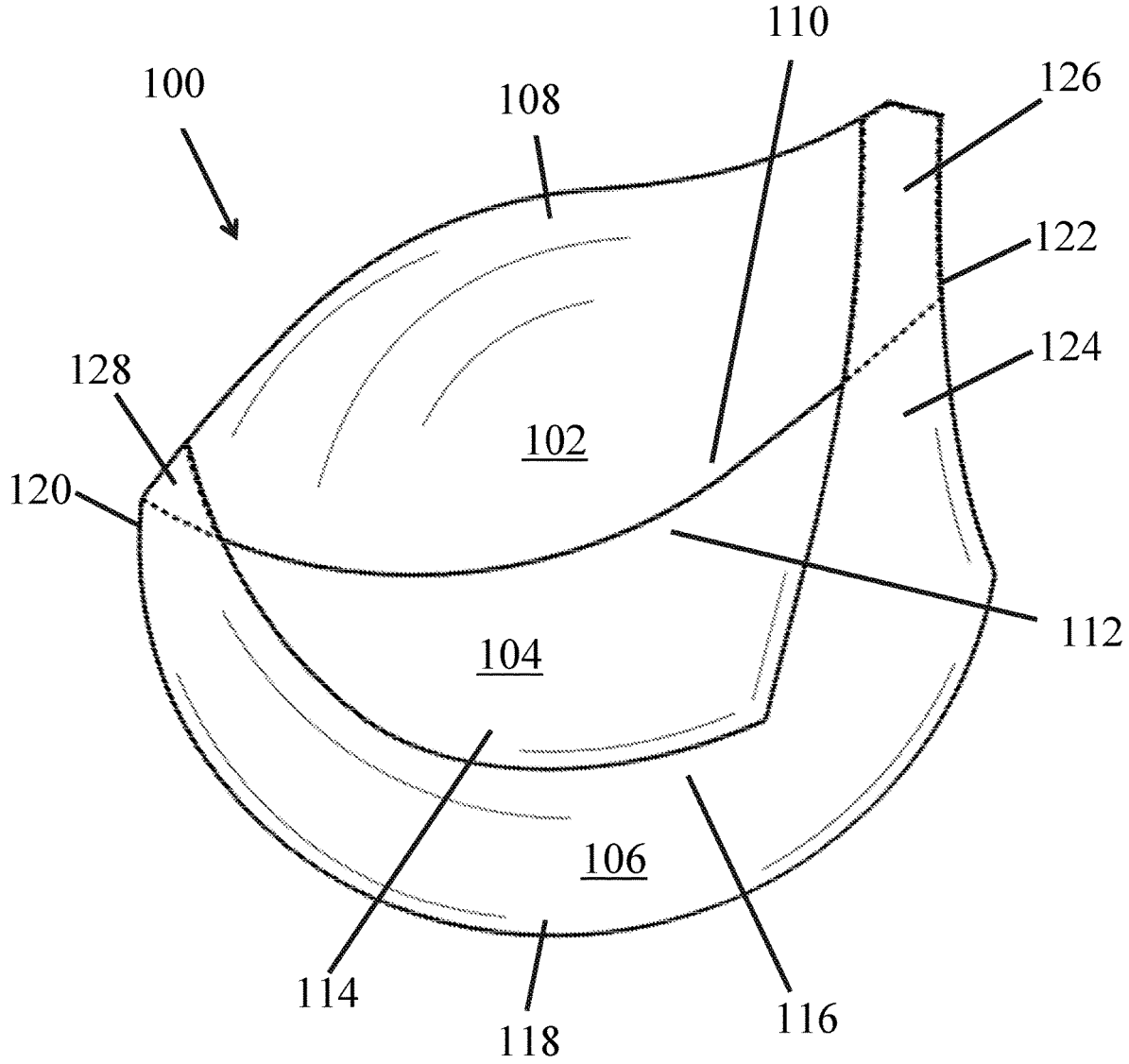
FIG. 1 depicts a rear view of a right bra pad in an underwire configuration in accordance with an exemplary embodiment of the present disclosure.
Figure 2:
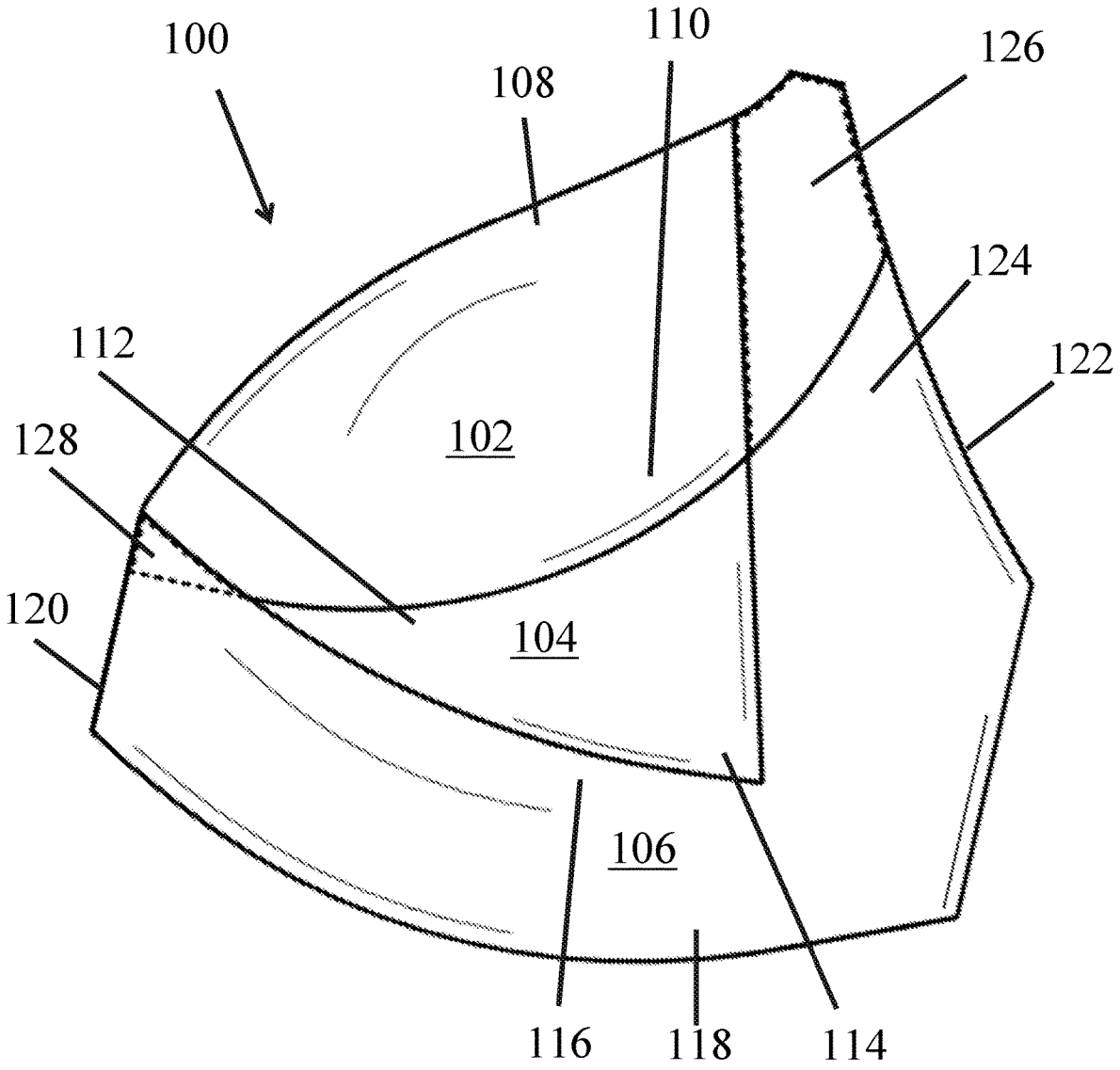
FIG. 2 depicts a rear view of a right bra pad in a wireless configuration in accordance with another exemplary embodiment of the present disclosure.

The bra pad of the present disclosure is adapted to be used in or as bra cups for use in articles of clothing such as bras, camisoles, tank tops, slips, dresses, bathing suits, or any other breast covering garment where padding and/or support is desired and is configured to provide optimum support, comfort, fit, coverage and appearance to the wearer. The bra pad of the present disclosure is generally cup-shaped with an outer convex surface and an inner concave surface. It should be noted that unless indicated otherwise any discussion regarding the configuration of the bra pad of the present disclosure is with respect to the orientation of when the bra pad is placed on the body of a wearer Referring generally to FIGS. 1 and 2, shown are exemplary embodiments of a bra pad (100) in accordance with the present disclosure. FIG. 1 depicts a version of bra pad (100) that may be used in connection with an article of clothing, such as bras and supportive garments that include an underwire support (not shown). FIG. 2 depicts a version of bra pad (100) that may be used in a connection with an article of clothing, such as bras and supportive garments that do not include an underwire support. While the shapes of bra pad (100) and their individual components in FIGS. 1 and 2 vary slightly, it should be understood, as explained below, that they contain generally the same or similar configuration, comprise the same or similar materials and achieve the same or similar benefits.

As shown in FIGS. 1 and 2, bra pad (100) comprises a top zone (102), a middle zone (104), and bottom zone (106)

when viewed in the orientation of when bra pad (100) is placed on the body of a wearer. Top zone (102) has a top portion (108) and a bottom portion (110), is generally crescent-shaped and comprises a stretchable material. It should be understood that any fabric or material with some degree of stretch or flexibility known in the art can be used in connection with top zone (102). Moreover, it should also be understood that any fabric or material may be used in connection with top zone (102) that comprises sufficient stretching properties to allow top zone (102) to fit against and along the wearer's neckline or near the top of the wearer's breasts. When an article of clothing (not shown) containing bra pad (100) is worn, top zone (102) is configured such that it extends along the neckline or top of the wearer's breasts from the inner edge (120) of bra pad (100) to the outer edge (122) of bra pad (100).

Top zone (102) may comprise a stretchable material, which, when worn, may be designed to fit snugly against and along the wearer's neckline or near the top of the wearer's breasts and may be further designed to stretch and recover specific to the wearer's body to accommodate the wearer's body throughout the day and for extended periods of time. That is, top zone (102), comprising stretchable material, may contain stretching properties and may be designed to stretch and accommodate the wearer's body at the neckline or near the top of the wearer's breasts for extended periods of time to maintain comfort, support, fit, coverage and appearance. Top zone (102) may also contain properties that allow it to contract or fully recover from a stretched position back to its original position and, therefore, may be designed to adapt to the wearer's body and accommodate the wearer's breasts and body as it fluctuates in size and shape. In other words, top zone (102) may be constructed such that its stretching properties do not get exhausted or used up, and can snap back or recover to its original position so as to maintain a snug fit to the wearer's body. The stretching and recovery properties of top zone (102) of the bra pad may also provide improved support, comfort, fit and coverage, while preventing top and/or side cup overflow and cup gaping. For example, by stretching to sufficiently accommodate the wearer's breasts, top zone (102) of bra pad (100) may fully and comfortably cover the top and sides of the wearer's breasts and does not pinch or cut into the wearer's breasts, thus creating a comfortable, supportive fit that prevents the top and side portions of the wearer's breasts from overflowing or bulging out of the bra pad. Moreover, by fully recovering and maintaining a snug fit along the top of the wearer's breasts as the wearer's body and/or breasts fluctuate in size and shape, top zone (102) of bra pad (100) prevents cup gaping.

As also shown in FIGS. 1 and 2, bra pad (100) may further comprise middle zone (104). Middle zone (104) has a top portion (112) and a bottom portion (114), is generally crescent-shaped and comprises a lightweight, flexible foam material or similar materials. It should be understood that any fabric or material that is generally lightweight and has some degree of stretch or flexibility known in the art can be used in connection with middle zone (104). Bra pad (100) may be constructed such that top portion (112) of middle zone (104) is coupled to bottom portion (110) of top zone (102) preferably through a molding process. Middle zone (104) is designed to fit snugly and comfortably against the middle and lower portions of the wearer's breasts to provide additional support and comfort to those areas when bra pad (100) is worn.

Bra pad (100) may further comprise bottom zone (106). Bottom zone (106) has a top portion (116) and a bottom portion (118), is generally curved or crescent-shaped and comprises a generally rigid stabilizing material that provides some flexibility to accommodate the lower portion of the wearer's breasts. Bra pad (100) may be constructed such that top portion (116) of bottom zone (106) is coupled to bottom portion (114) of middle zone (104) preferably through a molding process. Bottom zone (106) extends along the entire bottom of bra pad (100) from inner edge (120) of bra pad (100) to outer edge (122) of bra pad (100). Bottom zone (106) is designed and configured such that when an article of clothing (not shown) containing bra pad (100) is worn, bottom zone (106) extends along and/or below the bottom portion of the wearer's breasts to fit snugly and comfortably, and to provide additional support and comfort to those areas.

As also shown in FIGS. 1 and 2, bottom zone (106) comprises an additional support component or sling portion (124) that extends substantially vertically along outer edge (122) or the armpit side of bra pad (100). Sling portion (124) may be coupled to both middle zone (104) and top zone (102), as shown in FIGS. 1 and 2, preferably through a molding process. When bra pad (100) is worn, sling portion (124) fits snugly around the side of the wearer's breasts and provides additional support to that area.

Bottom zone (106) may also curve upward along inner edge (120) of bra pad (100) following the general shape of the bottom and side portion of the wearer's breasts and may be coupled to top zone (102), preferably through a molding process, to provide additional support to that area.

Bottom zone (106) of bra pad (100) may comprise a firm, stabilizing material with minimal or restrictive stretching properties, which is designed to fit snugly along the bottom of the wearer's breasts to provide improved support, comfort, fit and appearance to the wearer. Bottom zone (106) of bra pad (100) may be designed to flex along the bottom of the wearer's breasts to provide additional support and to provide "lift" to the breasts. It should be understood that any firm or rigid fabric or material known in the art can be used in connection with bottom zone (106). Moreover, it should also be understood that any fabric or material may be used in connection with bottom zone (106) that is firm yet comprises sufficient stretching properties to allow bottom zone (106) to flex along the bottom of the wearer's breast and provide additional support to the breasts. While it may be flexible enough to accommodate the varying sizes of the wearer's breasts as they grow and/or shrink, bottom zone (106) is rigid enough to provide additional support to the wearer's breasts. Moreover, the material used to create bottom zone (106) may comprise certain properties that allow it to be flexible enough to not dig into the wearer's breast tissue but firm enough to provide adequate support to the wearer's breasts. Sling portion (124) may be constructed of similar or the same firm, stabilizing material. Sling portion (124) may provide further support to the side and bottom of the wearer's breasts and may push the wearer's breasts forward to prevent side bulge or cup overflow.

As shown in FIGS. 1 and 2, sling portion (124) may overlap with and be coupled (e.g., through a molding process) to top zone (102) at or near a strap point (126) of bra pad (100). Strap point (126) is where a bra strap (not shown) of a bra (not shown) may connect to bra pad (100). The combination of top zone (102) with sling portion (124) makes strap point (126) more rigid and thus provides additional support to the wearer near that area of bra pad (100).

Further, bottom zone (106) may overlap with and be coupled (e.g., through a molding process) to top zone (102) at a point (128) near inner edge (120) of bra pad (100). The combination of top zone (102) with bottom zone (106) makes point (128) more rigid and thus provides additional support to the wearer near that area of the bra pad (100).

It should be appreciated that while three zones are shown in FIGS. 1 and 2 and described above, it is contemplated that bra pad (100) may be comprised of just two of the aforementioned zones in any combination and in any configuration. For example, it is contemplated that bra pad (100) may comprise just top zone (102) and bottom zone (106). In such an embodiment, bra pad (100) may be constructed such that top portion (116) of bottom zone (106) is coupled to bottom portion (110) of top zone (102) preferably through a molding process. In another example, it is contemplated that bra pad (100) may comprise just top zone (102) and middle zone (104). In such an embodiment, bra pad (100) may be constructed such that top portion (112) of middle zone (104) is coupled to bottom portion (110) of top zone (102) preferably through a molding process. In yet another example, it is contemplated that bra pad (100) may comprise just middle zone (104) and bottom zone (106). In such an embodiment, bra pad (100) may be constructed such that top portion (116) of bottom zone is coupled to bottom portion (114) of middle zone preferably through a molding process.

It should be understood that each of the aforementioned zones (102, 104 and 106), including sling portion (124), of bra pad (100) may be coupled together using any molding process known in the art. For example, zones (102, 104 and 106) and sling portion (124) may be coupled together by positioning zones (102, 104 and 106) and sling portion (124) between two foam sheets and then molding the layered structure together under heat and pressure to create molded bra pad (100).

It should be further understood that while the bra pads of the present disclosure and their corresponding components have been shown and described to have certain shapes, the bra pads of the present disclosure and their corresponding components are not limited to any particular shape. That is, the bra pads disclosed herein and their corresponding components may be any shape without departing from the spirit of the present disclosure.

Figure 3:
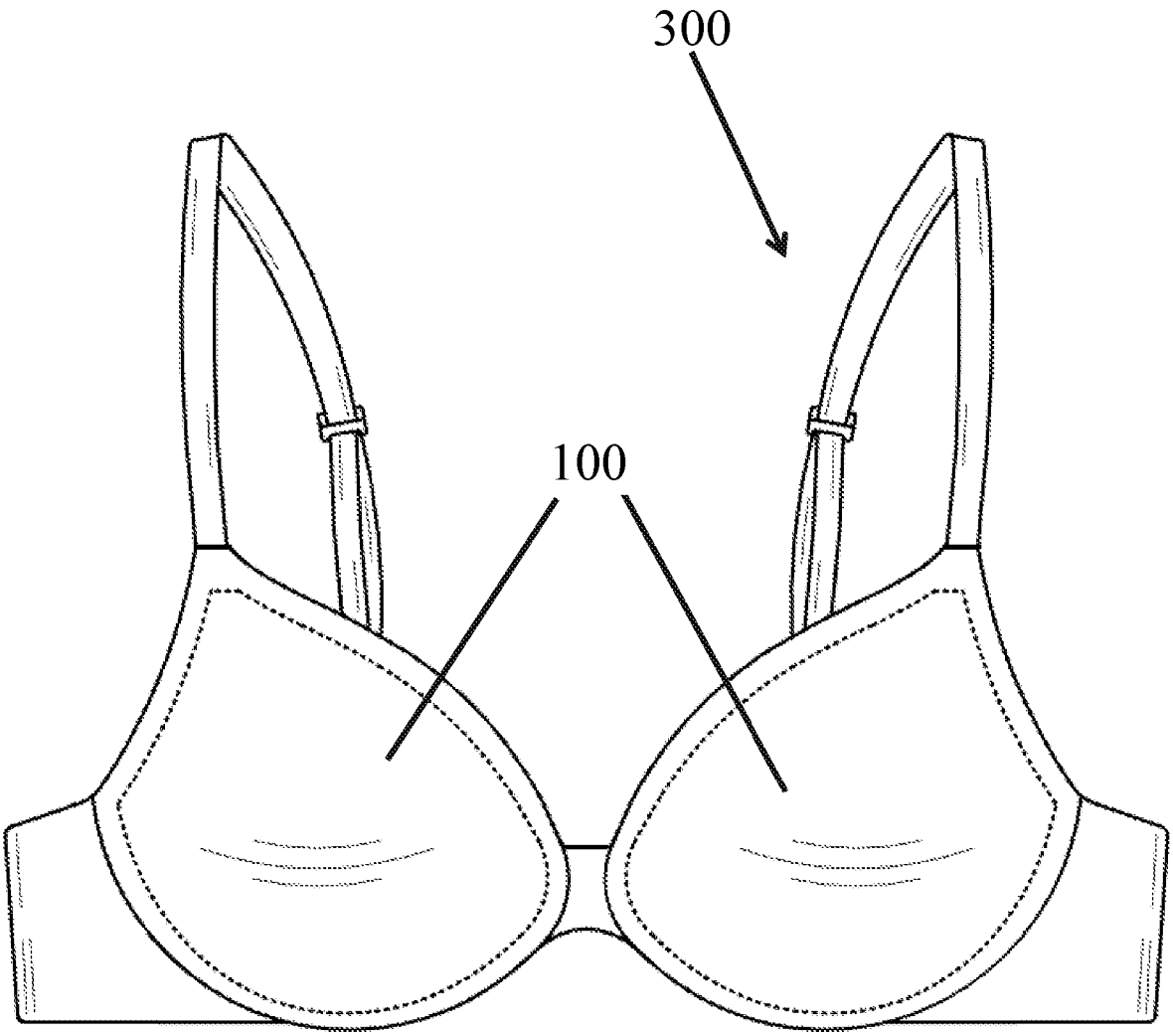
FIG. 3 depicts a front view of a bra comprising the left and right bra pads of the exemplary bra pad shown in FIG. 1.

Turning to FIG. 3, bra pads (100) are illustrated in the context of a traditional bra (300) to show how they may be incorporated into an article of clothing. It is further contemplated that bra pads (100) may be incorporated into the bra disclosed and described in commonly owned, co-pending application filed on the same date as the present application by inventors Emily Suess and Valerie Ann McArdle and Applicant Chico's Brands Investments, Inc., entitled "Bra with Intermediary Flexible Layer and Method for Manufacturing Same."

While the subject matter discussed herein has been described in detail with reference to embodiments for the purposes of making a complete disclosure, such embodiments are merely exemplary and are not intended to be limiting or represent an exhaustive enumeration of all aspects of the invention. It will be apparent to those of ordinary skill in the art that numerous changes may be made in such details, and the invention is capable of being embodied in other forms, without departing from the spirit, essential characteristics, and principles of the invention. Also, the benefits, advantages, solutions to problems, and any elements that may allow or facilitate any benefit, advantage, or solution are not to be construed as critical, required, or essential to the subject matter disclosed. The scope of the invention is to be limited only by the appended claims.

What is claimed is:

1. A bra pad configured to be placed on a body of a wearer, the bra pad comprising:

a first zone comprising a stretchable material;

a second zone coupled to the first zone and comprising a rigid material, the second zone further comprising:

a first portion extending substantially vertically along an outer edge of the bra pad, wherein the first portion is made of fabric and is coupled to a first portion of the first zone, wherein the first portion of the second zone is further configured to push a breast of the wearer forward to prevent the breast from bulging out of the bra pad; and a second portion extending substantially horizontally from the first portion of the second zone to an inner edge of the bra pad, wherein the second portion is made of fabric and is coupled to a second portion of the first zone; and a third zone arranged between the first zone and the second zone and comprising a lightweight, stretchable material, wherein the first zone, the second zone and the third zone together are coextensive with an entire surface area of the bra pad; and wherein the first portion of the first zone overlaps the first portion of the second zone.

2. The bra pad of claim 1 wherein the first zone is a top zone of the bra pad that is configured to extend along and fit against a neckline of the wearer.

3. The bra pad of claim 2 wherein the first zone is adapted to recover and fit against the neckline of the wearer as the wearer's body fluctuates in size and shape.

4. The bra pad of claim 1 wherein the stretchable material of the first zone is configured to allow the first zone of the bra pad to cover a portion of the wearer's breast.

5. The bra pad of claim 1 wherein the second zone is a bottom zone of the bra pad that is configured to extend along a bottom portion of the breast of the wearer to support the breast from a bottom of the bra pad.

6. The bra pad of claim 1 wherein the rigid material is a firm, stabilizing material with a low degree of stretchability configured to allow the second zone to flex along the bottom of the wearer's breast while still providing support to the wearer's breast.

7. The bra pad of claim 1, wherein the bra pad is configured to be incorporated into one of a camisole, a tank top, a slip, a dress, and a bathing suit.

8. The bra pad of claim 1, wherein the second portion of the first zone overlaps the second portion of the second zone.

9. The bra pad of claim 1, wherein a top portion of the third zone is coupled to the first zone and a bottom portion of the third zone is coupled to the second zone.

10. The bra pad of claim 1 wherein the stretchable material of the first zone is configured to allow the first zone of the bra pad to cover a portion of the wearer's breast.

11. A method for manufacturing a bra pad, the method comprising:

providing a first zone comprising a stretchable material;

coupling a second zone comprising a rigid material to the first zone, wherein the coupling comprises:

coupling a first portion of the second zone extending substantially vertically along an outer edge of the bra pad to a first portion of the first zone, wherein the first portion of the second zone is configured to push a breast of a wearer forward to prevent the breast from bulging out of the bra pad; and coupling a second portion of the second zone extending substantially horizontally along an inner edge of the bra pad to a second portion of the first zone, wherein the second portion of the first zone overlaps the second portion of the second zone; and coupling a third zone between the first zone and the second zone, wherein the third zone comprises a lightweight, stretchable material, wherein the first zone, the second zone, and the third zone together are coextensive with an entire surface area of the bra pad.

12. The method of claim 11 wherein the first zone is a top zone of the bra pad that is configured to extend along and fit against a neckline of the wearer.

13. The method of claim 12 wherein the first zone is adapted to recover and fit against the neckline of the wearer as the wearer's body fluctuates in size and shape.

14. The method of claim 11 wherein the stretchable material of the first zone is configured to allow the first zone of the bra pad to cover a portion of the wearer's breast.

15. The method of claim 11 wherein the second zone is a bottom zone of the bra pad that is configured to extend along a bottom portion of a breast of a wearer to support the breast from a bottom of the bra pad.

16. The method of claim 11, wherein the first portion of the first zone overlaps the first portion of the second zone.

17. The method of claim 11 wherein the rigid material is a firm, stabilizing material with a low degree of stretchability configured to allow the second zone to flex along the bottom of the wearer's breast while still providing support to the wearer's breast.

18. The method of claim 11, further comprising incorporating the bra pad into one of a camisole, a tank top, a slip, a dress, and a bathing suit.

19. The method of claim 11, wherein a top portion of the third zone is coupled to the first zone and a bottom portion of the third zone is coupled to the second zone.

20. A bra pad configured to be placed on a body of a wearer, the bra pad comprising:

a first zone comprising a stretchable material;

a second zone coupled to the first zone and comprising a rigid material, the second zone further comprising:

a first portion extending substantially vertically along an outer edge of the bra pad, wherein the first portion is made of fabric and is coupled to a first portion of the first zone, wherein the first portion of the second zone is further configured to push a breast of the wearer forward to prevent the breast from bulging out of the bra pad; and a second portion extending substantially horizontally from the first portion of the second zone to an inner edge of the bra pad, wherein the second portion is made of fabric and is coupled to a second portion of the first zone; and a third zone arranged between the first zone and the second zone and comprising a lightweight, stretchable material, wherein the first zone, the second zone and the third zone together are coextensive with an entire surface area of the bra pad; and wherein the second portion of the first zone overlaps the second portion of the second zone.

21. The bra pad of claim 20 wherein the first zone is a top zone of the bra pad that is configured to extend along and fit against a neckline of the wearer.

* * * * *